US008689986B2

(12) United States Patent
Richter

(10) Patent No.: US 8,689,986 B2
(45) Date of Patent: Apr. 8, 2014

(54) TELESCOPIC CRANE WITH SELF-MOUNTING BRACING DEVICE AND METHOD OF MOUNTING A BRACING DEVICE

(75) Inventor: Frank Richter, Wilhelmshaven (DE)

(73) Assignee: Manitowoc Crane Group France SAS, Ecully (FR)

( * ) Notice: Subject to any disclaimer, the term of this patent is extended or adjusted under 35 U.S.C. 154(b) by 781 days.

(21) Appl. No.: 12/775,161

(22) Filed: May 6, 2010

(65) Prior Publication Data

US 2010/0282700 A1 Nov. 11, 2010

(30) Foreign Application Priority Data

May 7, 2009 (DE) ..... 10 2009 020 338

(51) Int. Cl.
*B66C 23/70* (2006.01)

(52) U.S. Cl.
USPC ..... 212/177; 212/347

(58) Field of Classification Search
USPC ..... 212/292, 175, 177, 347, 348, 350, 301, 212/302
See application file for complete search history.

(56) References Cited

U.S. PATENT DOCUMENTS

| | | | | | |
|---|---|---|---|---|---|
| 2,936,907 | A * | 5/1960 | Woodruff | 212/289 |
| 2,998,856 | A * | 9/1961 | Larsen et al. | 173/195 |
| 4,102,094 | A * | 7/1978 | MacKinnon | 52/116 |
| 4,273,244 | A * | 6/1981 | Jensen et al. | 212/181 |
| 4,383,792 | A * | 5/1983 | Seabloom et al. | 414/563 |
| 4,434,994 | A * | 3/1984 | Pepin | 280/404 |
| 4,662,527 | A * | 5/1987 | Cuhel | 212/180 |
| 4,700,851 | A * | 10/1987 | Reeve et al. | 212/181 |
| 5,240,129 | A * | 8/1993 | Schrick et al. | 212/175 |
| 5,427,256 | A * | 6/1995 | Kleppe | 212/179 |
| 5,484,069 | A * | 1/1996 | Lanning | 212/270 |
| 5,642,821 | A * | 7/1997 | Hafliger | 212/177 |
| 5,690,240 | A * | 11/1997 | Thiermann, Sr. | 212/180 |
| 5,725,112 | A * | 3/1998 | Thorby | 212/180 |
| 5,765,248 | A * | 6/1998 | Ono | 14/75 |
| 6,702,132 | B1 * | 3/2004 | Moore et al. | 212/270 |
| 7,044,315 | B2 * | 5/2006 | Willim | 212/299 |
| 7,331,748 | B2 * | 2/2008 | Knepp et al. | 414/686 |
| 7,686,174 | B2 * | 3/2010 | Willim | 212/298 |
| 7,874,438 | B2 * | 1/2011 | Despres | 212/292 |
| 8,192,128 | B2 * | 6/2012 | Orgeron | 414/22.55 |
| 2007/0059142 | A1 * | 3/2007 | Dambroseo | 414/561 |
| 2007/0163982 | A1 * | 7/2007 | Lichinchi | 212/175 |

FOREIGN PATENT DOCUMENTS

| | | | | |
|---|---|---|---|---|
| DE | 20 2005 005 627 | U1 | 9/2006 | |
| EP | 1342692 | A2 | 9/2003 | |
| JP | 2006-306533 | A | 11/2006 | |
| WO | WO 2005/092775 | A1 | 10/2005 | |
| WO | WO 2005092775 | A1 * | 10/2005 | B66C 23/42 |

* cited by examiner

*Primary Examiner* — Emmanuel M Marcelo
*Assistant Examiner* — Michael Gallion
(74) *Attorney, Agent, or Firm* — Steven P. Shurtz; Brinks Gilson & Lione

(57) ABSTRACT

The invention relates to a system for bracing a telescopic crane, in particular a mobile crane, with a bracing unit which can be mounted on the jib. The bracing unit comprises erectable bracing supports and a holding frame for securing the bracing unit to the jib. The holding frame has a cross-section which is open at the top and allows the jib to be inserted from above the bracing unit The invention also relates to a method of positioning and mounting such a bracing unit on the jib of a telescopic crane.

22 Claims, 8 Drawing Sheets

Figure 1:
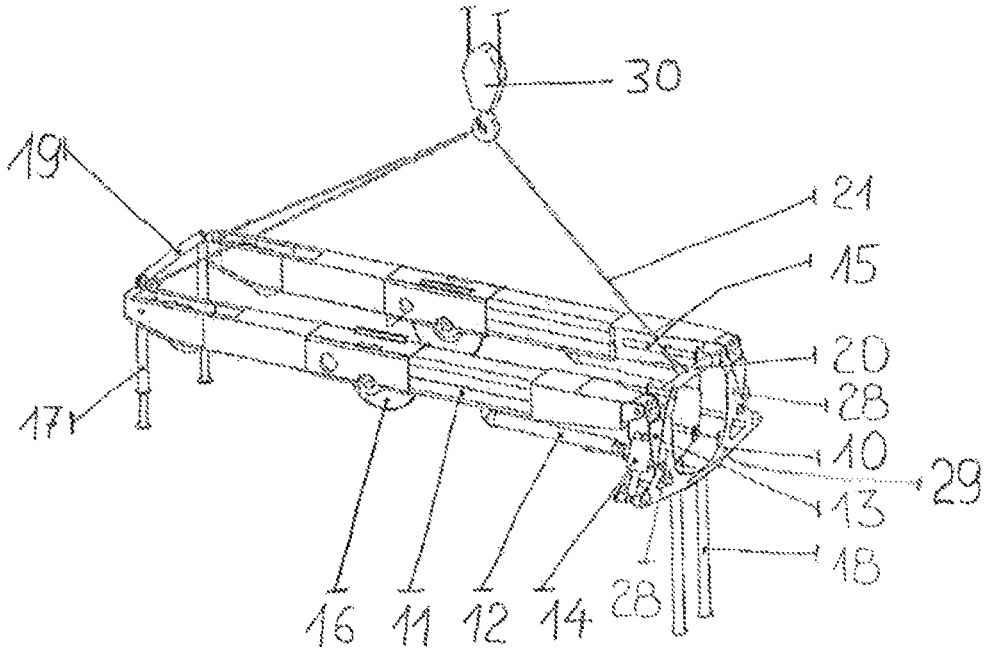

TELESCOPIC CRANE WITH SELF-MOUNTING BRACING DEVICE AND METHOD OF MOUNTING A BRACING DEVICE

The invention relates to bracing used in conjunction with telescopic cranes, in particular mobile cranes.

Bracing systems are used with cranes and telescopic cranes as a means for increasing the stability and stiffness, and thus the bearing capacity of the crane jib. Often the bracing system is provided in the form of an integral unit, which may also be referred to as a "guying frame". Such an arrangement has erectable bracing struts and a holding frame which is secured to the crane jib. Cables are run to the jib head and tensioned by means of the bracing struts, whereby the cables absorb some of the forces acting on the jib, thereby taking up some of the load and improving stiffness. The bracing struts are typically secured by means of bracing members in the region of the jib axis of rotation.

In the case of larger mobile cranes, the bracing unit itself is quite large and heavy and cannot be pre-mounted on the jib when the crane is being transported to the deployment site because it would not be possible to comply with highway height and/or weight restrictions. In such cases, the bracing unit is transported separately to the deployment site where, as known from the prior art, the bracing unit has to be mounted on the jib. Such mounting often requires use of an additional hoist, e.g. another crane. The very fact that it is necessary to use another hoist makes this approach expensive. It is also generally labor-intensive and time-consuming. At times, job site conditions may make it unusually difficult or impractical to position another crane to perform this task.

Patent specification WO 2005/092775 A1 discloses a bracing system whereby a bracing unit is positioned at a point in front of a mobile crane, and the mobile crane together with its jib is then driven underneath the bracing unit, which is mounted on struts, which is then secured on the jib. The disadvantage of this is that a strut construction of this type is very high and correct positioning in order to connect the jib and bracing unit is complicated.

Patent specification EP 1 342 692 B1 discloses a bracing system, whereby two individual bracing struts can be positioned on brackets disposed on the vehicle to the right and left of the telescopic jib. In this instance, the two bracing struts have to be transported, moved and positioned separately.

The objective of the present invention is to provide a telescopic crane with a self-mounting bracing device, and a method for mounting a bracing device, which overcomes the problems outlined above.

A telescopic crane-bracing unit system according to the invention comprises a telescopic crane, in particular a mobile crane, including a bogie or transport platform and a superstructure mounted on it so that it can be rotated. An erectable jib is disposed on the rotatable superstructure. the jib comprises an outer jib base part and one or more telescopic jib parts. A bracing unit which can be mounted on the jib has erectable bracing supports and a holding frame for attaching the bracing unit to the jib. According to the invention, the holding frame connects the bracing supports to the jib to form a unit. The holding frame has a cross-section which is open at the top, which enables the jib to be inserted and engaged from its open position.

An advantage of the present invention is that the bracing unit can be designed so that it is in a low position for the purpose of mounting it on the crane. Because the jib can gain access to the holding frame from above, the bracing unit can be positioned relatively low to enable the connection with the jib to be established. Another advantage is that the bracing unit can be provided as an integral unit with the holding frame, which can be easily transported, moved and positioned in this manner.

In one embodiment of the invention, the holding frame is designed to accommodate a jib assembly portion, which may be a jib part collar.

According to the invention, a jib-bracing unit is supported and positioned in a defined manner with respect to a crane jib so that the jib can be easily and reliably positioned and mounted in a holding frame of the bracing unit by moving the jib into engagement with the frame. In one embodiment of the invention, auxiliary supports are provided at the free ends of the erecting struts and/or on the holding frame of the bracing unit for supporting the bracing unit during transportation.

The invention provides an arrangement for positioning the jib and bracing unit relative to one another in a defined and reproducible manner, which offers major advantages, especially on a building site. Due to the fact that positioning of the bracing unit for mounting to the jib can be standardised, the jib merely has to be "moved alongside" it to enable mounting to be initiated. A separate hoist is no longer necessary. Because the approach is standardised, the mounting process is simple and safe and reliably facilitates a secure fixing of the bracing unit. As a result, the invention reduces costs and effort previously associated with such operations.

A positioning unit according to the invention may comprise positioning elements disposed at points which establish a defined positional relationship between the jib and holding frame. The invention may be implemented in such a way that the positioning means used to obtain a defined position of the bracing unit positions the bracing unit with its holding frame at a distance from the crane superstructure articulation point of the jib corresponding to the bracing unit-mounting length of the jib.

The invention provides an apparatus and method by which the jib can be correctly and easily positioned with respect to the holding frame of the bracing unit in order to establish the connection without any problems. In accordance with the invention the necessary relative positions of the jib and the bracing unit can be easily obtained in a defined and reproducible manner. To achieve this result, according to one aspect of the invention, co-operating parts of the positioning means may be placed on both the telescopic crane and on the bracing unit.

The positioning means or elements utilized as part of the invention may be configured in various conceivable ways in order to implement the invention, provided it fulfills its positioning function with greater or lesser input on the part of operators. For example, the invention may incorporate positioning or alignment elements comprising stops, fixed markings, fixing elements which prevent relative movement in at least one plane or direction, releasable catch mechanisms, support holders in the form of indentations, recesses or the like, which have a circumferentially extending means for preventing lateral movement of a support in the holder, demountable positioning or setting supports on the bracing unit, or any other suitable means or device. In accordance with the invention, bracing unit-lifting means, such as fixing points on the bracing unit for receiving lifting cables, are provided to facilitate lifting and movement of the bracing unit with the jib that is to receive the bracing unit.

The invention relates also to a method of mounting a bracing unit on the jib of a telescopic crane. In accordance with the invention, a bracing unit is positioned in a defined position with respect to the crane, either on the crane itself or on a surrounding surface. The lifting of the bracing unit is done by the lifting means provided on the jib of the crane, and another crane to perform this lifting function is not required. Once the bracing unit is positioned, a connection between the jib of the crane and the bracing unit is easily and reliably effected by simply moving the jib into a holding frame of the bracing unit.

The jib is moved into engagement with the frame of the bracing unit in order to establish the connection of the jib in the holding frame from a position above the holding frame, the frame being open at the top.

Figure 2:
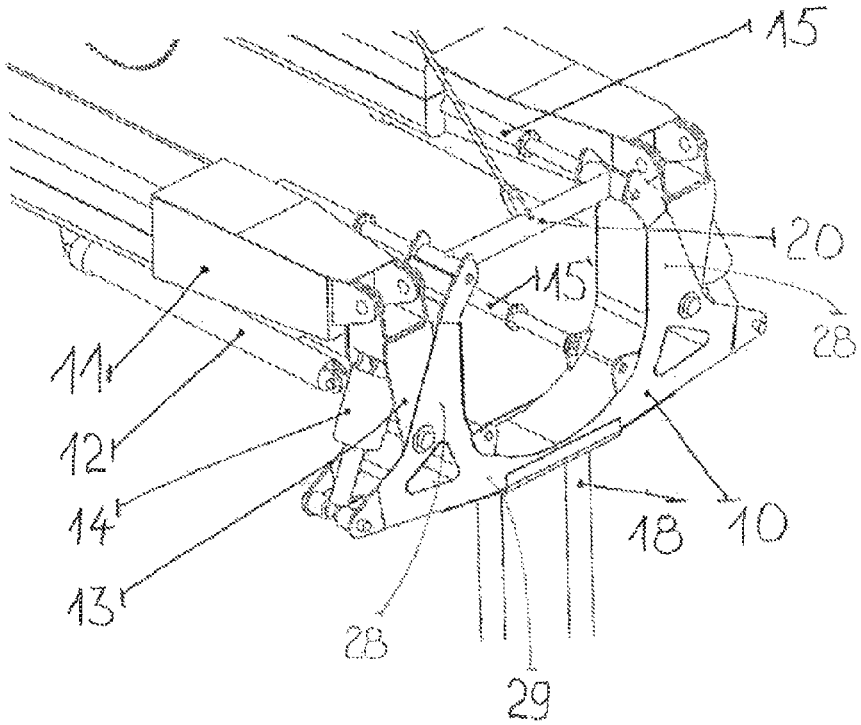
Figure 6:
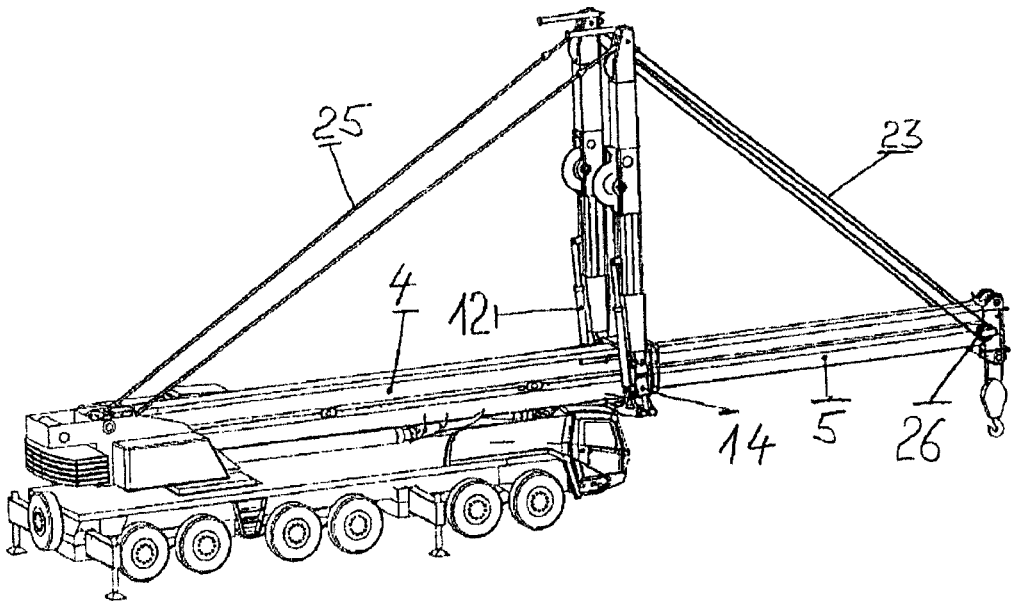
Figure 7:
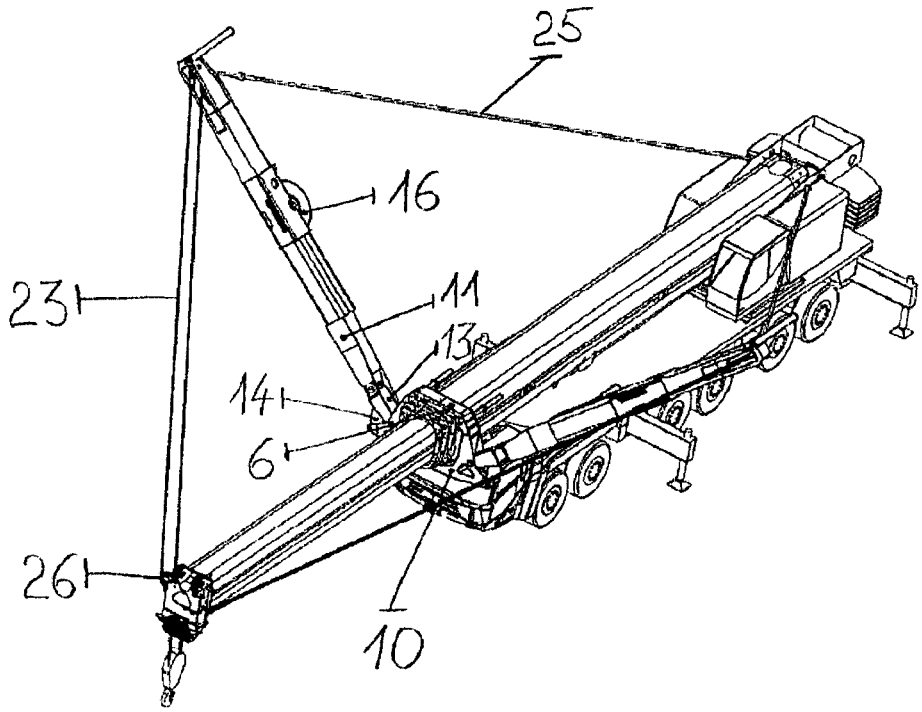
Figure 8:
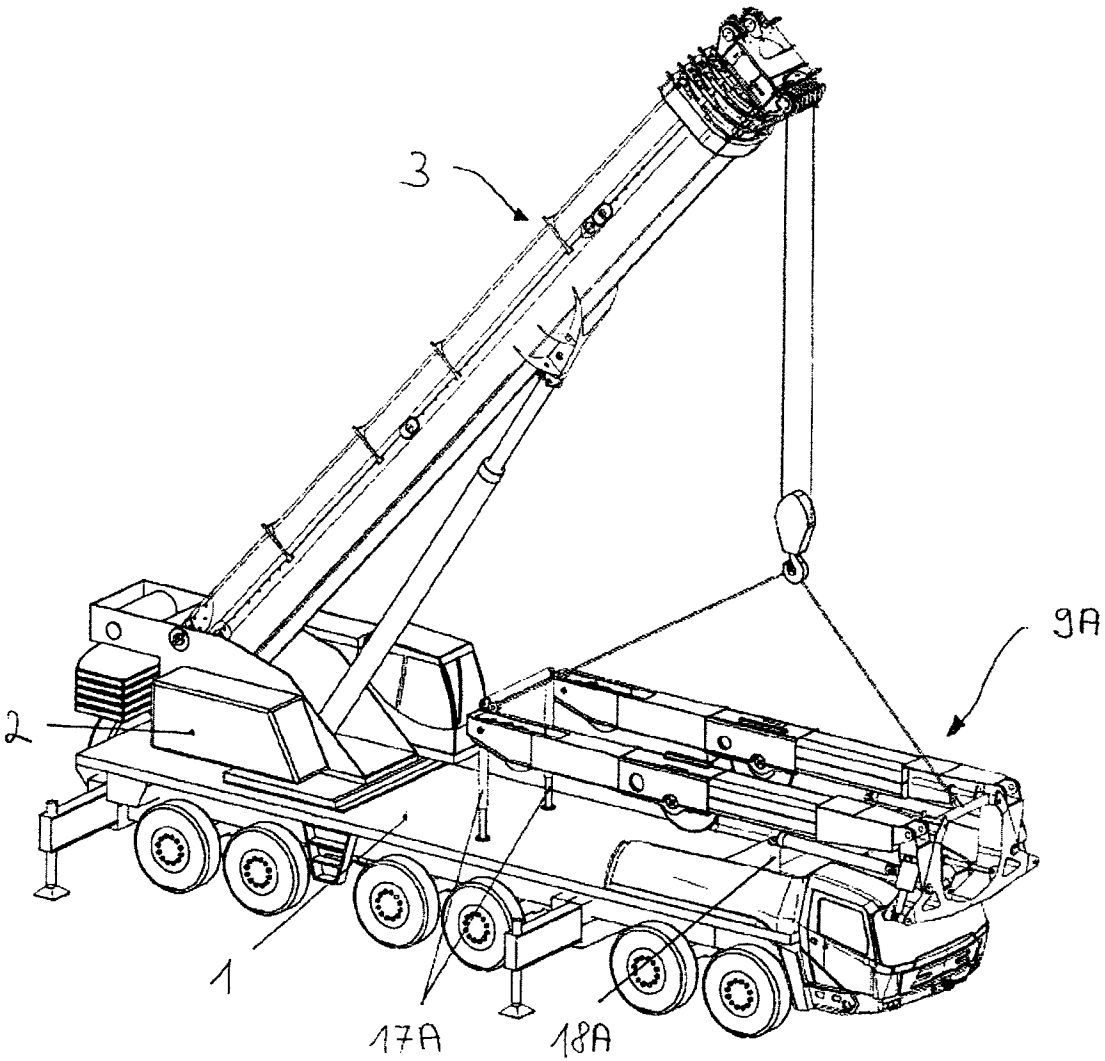

The invention will be better understood by reference to the detailed description below of a preferred embodiment, considered together with the appended drawings, wherein:

FIG. 1: shows a bracing unit of the type which may be used according to the present invention;

FIG. 2: shows details of the bracing unit illustrated in FIG. 1 at the end where its holding frame for attaching to the jib is disposed;

FIGS. 3 to 7: are illustrations of different stages of the operation of mounting a bracing unit to a mobile crane according to the invention; and FIG. 8 is an illustration of an alternative embodiment of the invention.

Figure 4:
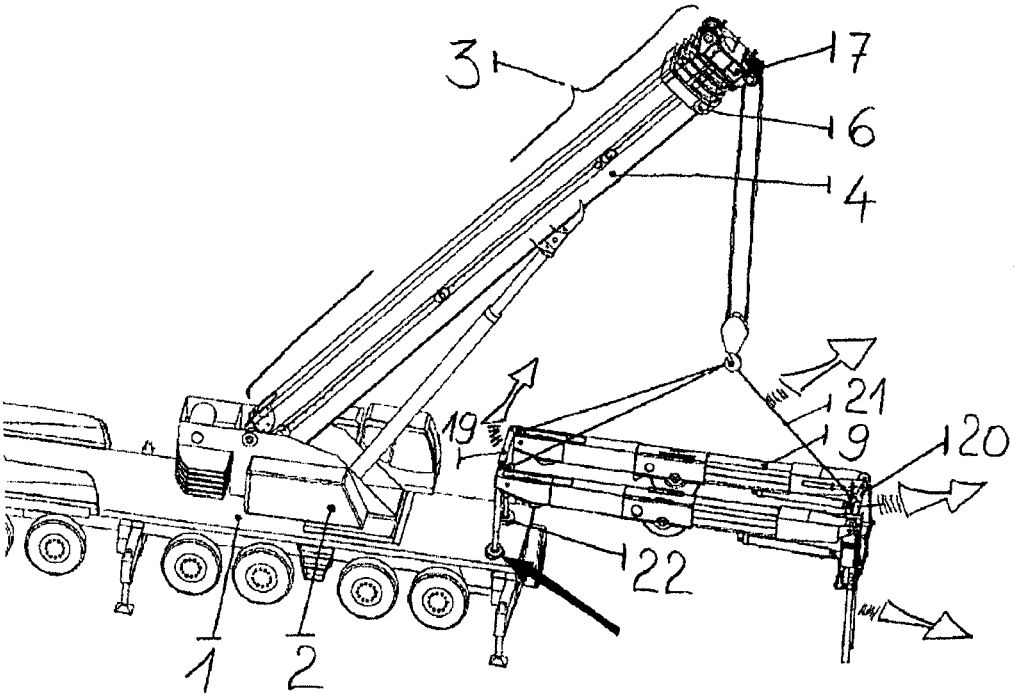

Referring first to FIG. 4, a transportable telescopic crane has a bogie 1, a rotatable superstructure 2 mounted on it, and a jib 3 mounted on the rotatable superstructure. Jib 3 comprises at least an outer jib base part 4 and one or more telescopic inner jib parts 5. As is well known, the jib can be raised and lowered by being pivoted about a horizontal axis by means of at least one luffing ram. Outer jib part 4 includes a collar region 6. A bracing device may be secured to the jib part 4 in the collar region 6. A bracing device may include struts that can be, for example, hydraulically erected in the luffing plane of the jib or pivoted to both sides of the jib. Bracing lines can be attached to the jib at the jib head 26, for example (FIG. 6) or to some other point along the jib for increasing the stiffness if the jib and reduce flexing transversely to the jib longitudinal axis.

A complete bracing unit 9 (FIG. 3) may be transported separately from the telescopic crane. According to the invention the bracing unit is designed so that it can be fitted to the crane by means of the crane itself, and does not call for an additional crane to accomplish this function.

Figure 3:
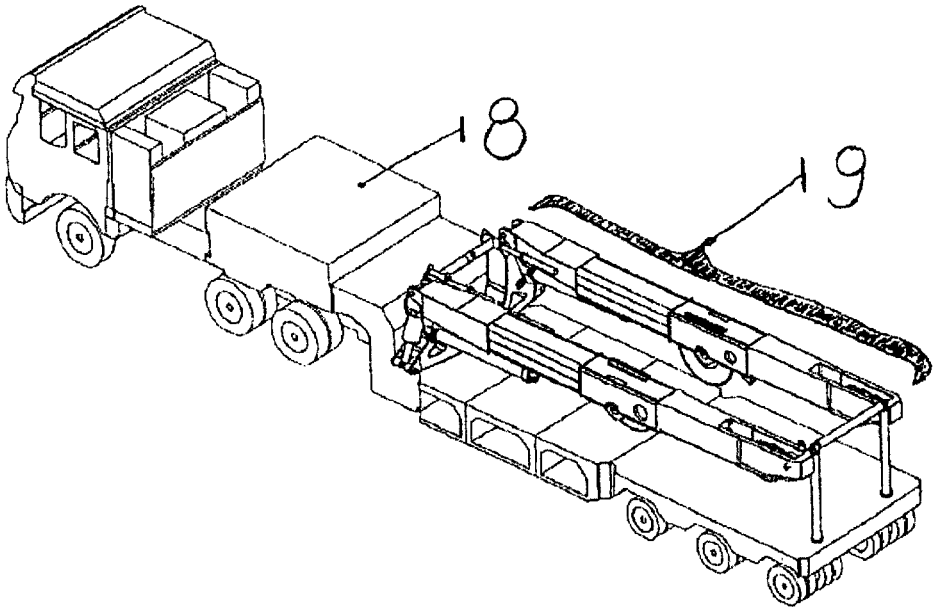

As noted above, a transportable crane includes a bogie and a rotatable superstructure 2 supporting luffing jib 3. At its outer end, the outermost jib part or jib base part 4 incorporates a collar 6. Collar 6 provides a connection for attaching to the jib a bracing device 9 (FIG. 3) by means of a holding frame 10 forming part of the bracing device. As shown in FIG. 3, a transport vehicle 8 may be used to transport a bracing unit 9 to the site where it will be deployed and attached to a crane.

Referring to FIGS. 1 and 2, holding frame 10 of the bracing device is a substantially rigid, bending-resistant frame that is open at its top portion. Frame 10 serves as an interface with, for example, collar 6 or some other portion of the outer jib part. Frame 10 supports on each side thereof elements 11, 12, 13, 14.

Figure 5:
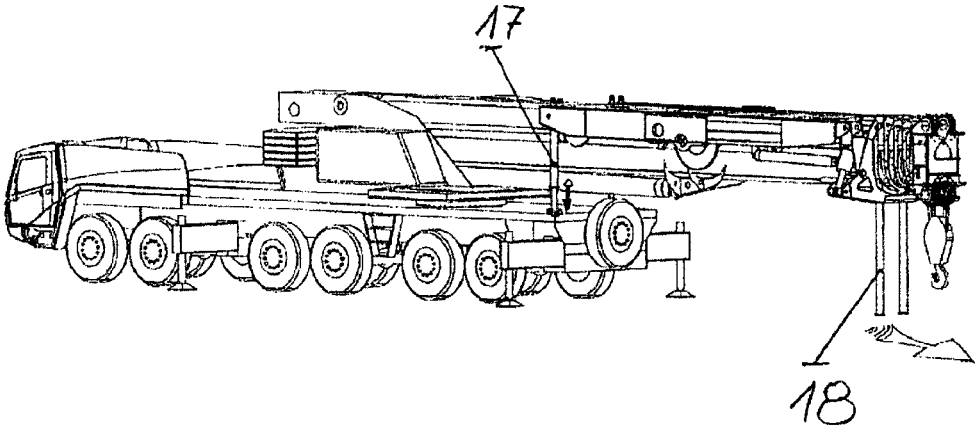

Reference numeral 11 denotes a bracing strut, there being provided a bracing strut 11 on each lateral side of frame 10. An erecting cylinder 12 is associated with each strut 11 and is used to pivot the associated bracing strut in an upward direction, as seen in FIGS. 1 and 2, up to an angle of approximately 90° to the jib in the luffing plane. Each strut is pivotally mounted to a pivot block 13 for pivotal movement in the luffing plane when acted upon by cylinder 12 as noted. Element 13 is itself a pivot block that is pivotable about an axis parallel to the longitudinal axis of the jib. A pivoting cylinder 14 is provided for pivoting block 13 about the axis parallel to the jib longitudinal axis for pivoting the struts to positions laterally to each side of the jib, when this is desired. As best seen in FIGS. 1 and 2, the frame 10 comprises two side members 28 and a cross member 29 connected between the two side members. When the bracing unit is attached to the jib, the side members 28 extended to a point below the jib such that the cross member 29 is located below the jib (FIG. 5).

One or more locking cylinders 15 is provided on the bracing device to each jib side respectively, for connecting the holding frame 10 to collar 6. this may be accomplished, for example, by actuating cylinders 15 to insert a pin through receiving apertures in jib collar 6 to thereby secure bracing device 9 to the jib. Each strut typically includes a winch unit 16 or similar means for accommodating guying or bracing cables 23 (FIGS. 6 and 7). Guying cables 23 may be paid out or reeled in to accommodate the variable distance to the jib head 26.

An apparatus according to the invention further includes, as seen in FIGS. 1 and 2, a pair of length-adjustable support elements, also referred to as struts, 17 at one end of the bracing device. A pair of demountable support elements, also referred to as struts, 18 are provided at the other end. Detachable stays 19 and 20 are provided, primarily for maintaining the bracing device 9 in a proper configuration during transport. The bracing device can be lifted by means of a cable hanger 21 and hook 30 of the crane itself, as illustrated in FIG. 1. A pair of fixed points 22 are provided on the bogie (FIG. 4) which serve as a positioning aid, as will be described below.

As illustrated in FIGS. 6 and 7, element 25 is a fixed guy extending between each erected strut 11 of bracing unit 9 and the base of the jib. As noted above, a guying cable 23 extends from each strut to the jib head 26.

The manner in which the bracing unit 9 is mounted to the crane will be described with reference being made to FIGS. 3 to 8.

As shown in FIG. 3, the bracing unit 9 can be transported to a job site by means of a transport vehicle, which might comprise a flatbed transport 8 or the like. In order to proceed with the mounting of the bracing device 9 to the crane, it is only necessary to bring the transport vehicle in sufficient proximity to the crane so that the crane can lift the bracing device from the transport vehicle using its hook 30. It is not necessary to position the transport vehicle in any other specific manner or orientation.

At the stage of installation illustrated in FIG. 4, the crane has lifted the bracing unit 9 from the transport vehicle by means of its own hook 30. When thus lifted, the suspended bracing device is easily brought to a position toward the end portion of the crane bogie and pivoted, as necessary, to be in alignment with the crane vehicle longitudinal axis, as illustrated. In this arrangement, the support struts 17 associated with the bracing device are moved into engagement with the fixed points 22 disposed on the crane bogie. The positioning of the support struts 17 on the fixed points 22 positions the bracing unit 9 exactly as necessary for coupling the bracing device to the jib by means of the frame 10 of the bracing device and collar 6 of the jib. The other end of the bracing device is supported in this position by support struts 18 as seen in FIGS. 4 and 5.

The stays 19 and 20 are then removed, whereby the top region of the device 9 is open and ready to engage the jib. As illustrated, the bracing unit supported by support struts 17 and 18 is disposed in a mounting position that is relatively low above the ground or above the vehicle, obviating the need for a support arrangement of a complex, cumbersome or costly construction or design. The entire bracing unit, including all structural and support elements, remains intact at every instant of deployment and through the process of mounting. This optimizes stability of the apparatus, simplifies its structure, reduces the cost of operation, and simplifies the process of moving, positioning and mounting the bracing device to a crane jib.

As illustrated in FIG. 5, when the bracing device 9 is positioned and supported on struts 17 and 18, and the stays 19 and 20 removed, the jib is then lowered whereby the collar 6 of base jib part 4 enters and is positioned within frame 10. Frame 10 is connected to collar 6 of the jib by means of the units 15 which inserts pins or bolts through suitable apertures in collar 6 and frame 10. A suitable connection to hydraulic and electrical interfaces is established so as to provide hydraulic power for operating devices 12, 14 and 15, for example.

Once the device 9 is mounted on the jib, as described, the struts 18 are removed and the struts 17 are folded or retracted.

The guy elements 25 may then be mounted and connected. The bracing supports 11 may then be moved upright by about 90° by means of the erecting cylinder 12. The cables 23 (FIGS. 6 and 7) may then be extended between the struts 11 and boom tip 26 or other suitable point of connection.

As illustrated in FIG. 7, if it is desired that the bracing device absorb lateral forces acting upon the jib, the bracing struts 11 may be pivoted laterally to each side of the jib by means of pivot block 13 to a prescribed angle.

FIG. 8 illustrates an alternative embodiment of the invention. In this embodiment, a bracing unit 9A according to the invention is positioned for transport entirely on the front end, i.e. the driver's cab end, of the mobile crane. This eliminates entirely the need to transport the bracing device on a separate transport vehicle. Support struts 17A and 18A are provided, corresponding to support struts 17 and 18, respectively, described above in reference to the first embodiment. The bracing device 9 is positioned on the transportable crane such that the collar of the base jib part aligns with frame 10 of the bracing device when the jib is lowered into engagement with the bracing device. This embodiment, thus, has the advantage that a defined initial position is always ready for positioning the bracing unit to be joined to the jib irrespective of the ground on which the crane is standing. Additionally, mounting and demounting of the bracing unit 9A can be accomplished in the same or corresponding way as that described in connection with the embodiments illustrated in FIGS. 1 to 7. That is, the bracing device 9A can be supported on support struts 17A and 18A on the adjacent ground surface for coupling to the jib.

The invention claimed is:

1. A bracing system for mounting on the jib of a crane comprising; a crane comprising a jib; and a bracing unit comprising a frame configured to receive the jib within said frame for attaching said bracing unit to the crane and a pair of erectable bracing supports mounted on opposite sides of said frame; said frame having a cross-section which is open at its top portion and allows the jib to be inserted from above the bracing unit for attaching said bracing unit to the jib, wherein the bracing system further comprises support elements for supporting said bracing unit in a mounting position, said support elements being connected to said bracing unit and extending therefrom in a direction which is substantially opposite to the direction to which the bracing unit is open.

2. A bracing system as in claim 1, wherein said frame comprises a portion configured to receive a part of the jib inserted into the frame for attaching said bracing unit to said jib.

3. A bracing system as in claim 2, wherein said jib comprises a collar portion associated with at least part of said jib, and said frame comprises a portion configured to receive and connect to the collar portion of the crane jib for attaching said bracing unit to the jib.

4. A bracing system as in claim 1, wherein said support elements are configured for positioning said bracing unit in a defined position relative to said crane for facilitating insertion of the jib of the crane into said frame of the bracing unit.

5. A bracing system as in claim 1 wherein said support elements are provided on said erectable bracing supports and on said frame of said bracing unit.

6. A bracing system as in claim 1, wherein said crane is a transportable crane and comprises a bogie, and said bracing unit is supported on said bogie at the time that the bracing unit is attached to the jib.

7. A bracing system as in claim 1, further comprising alignment elements for aligning the bracing unit in a defined manner relative to the crane whereby the jib of the crane can be inserted into the frame by lowering the jib into said open top portion.

8. A bracing system as claimed in claim 7, wherein the alignment elements define reference points which establish a defined distance between the jib and said frame.

9. A bracing system as in claim 2, further comprising alignment elements for aligning the bracing unit with respect to the crane wherein said frame is disposed at a position to receive a portion of the jib when the jib is lowered into the frame for attaching said bracing unit to said jib.

10. A bracing system as in claim 8, wherein said alignment elements comprise portions disposed on both the crane and on the bracing unit.

11. A bracing system as in claim 10, wherein said alignment elements comprise at least one fixing element on the crane and at least one fixing element on said bracing unit cooperating with the fixing element on the crane.

12. A bracing system as in claim 11, wherein alignment of said fixing elements positions said bracing unit with respect to the crane and said fixing elements restrain relative movement between the bracing unit and crane in at least one direction.

13. A bracing system as in claim 3, wherein the jib is a telescopic jib comprising a base jib part and at least one telescopic jib part, said base jib part comprising a collar portion, wherein said frame of the bracing unit is configured to receive and be secured to said collar portion.

14. A method for mounting a bracing unit to a jib of a crane, comprising: providing a bracing unit including a frame open at a top portion thereof and a pair of erectable bracing supports mounted on opposite sides of said frame; positioning said bracing unit adjacent to and below the crane jib; lowering the jib to thereby insert the jib into the frame through the open top portion thereof; and securing the frame of the bracing unit to the jib.

15. A method as in claim 14, further comprising utilizing the crane jib that is to receive the bracing unit to position the bracing unit adjacent to and below the jib.

16. A method as in claim 15, wherein said bracing unit is positioned on support elements by said jib in a position adjacent to and below the jib to receive the jib.

17. A method as in claim 16, wherein one or more of said support struts are placed into engagement with a portion of the crane to align the bracing support with the crane to receive the jib.

18. A method as in claim 15, wherein the jib lifts the bracing unit from a support that is separate from the crane and positions the bracing unit adjacent to and below the jib.

19. A method as in claim 18, wherein the crane is a transportable crane, comprising transporting the bracing unit by a separate vehicle, and lifting said bracing unit from said separate vehicle by the jib that is to receive the bracing unit, and positioning the bracing unit adjacent to and below the jib to receive the jib.

20. A method as in claim 14, comprising mounting the bracing unit on the crane to thereby position the bracing unit adjacent to and below the jib.

21. The bracing system of claim 1 wherein the frame comprises two side members and a cross member connected between the two side members, wherein when the bracing system is attached to the jib, the side members extend to a point below the jib such that the cross member is located below the jib.

22. The method of claim 14 wherein the frame comprises two side members and a cross member connected between the two side members, wherein when the bracing system is attached to the jib, the side members extend to a point below the jib such that the cross member is located below the jib.

* * * * *